US012359387B2

(12) United States Patent
Wang et al.

(10) Patent No.: US 12,359,387 B2
(45) Date of Patent: Jul. 15, 2025

(54) SOFT SOIL FOUNDATION SINGLE-HOLE DEPTH AIR COMPRESSION DRAINAGE DEVICE AND WORKING METHOD THEREOF

(71) Applicants: Zhejiang University, Zhejiang (CN); Ningbo China Communications Water Transportation Design and Research Co., Ltd., Zhejiang (CN)

(72) Inventors: Jun Wang, Zhejiang (CN); Hongyue Sun, Zhejiang (CN); Qingsong Shen, Zhejiang (CN); Qi Chen, Zhejiang (CN); Guangpeng Hong, Zhejiang (CN); Junwei Shu, Zhejiang (CN); Juan Zheng, Zhejiang (CN); Jilei Chang, Zhejiang (CN); Chao Fu, Zhejiang (CN)

(73) Assignees: ZHEJIANG UNIVERSITY, Hangzhou (CN); Ningbo China Communications Water Transportation Design and Research Co., Ltd., Ningbo (CN)

( * ) Notice: Subject to any disclaimer, the term of this patent is extended or adjusted under 35 U.S.C. 154(b) by 391 days.

(21) Appl. No.: 17/979,780

(22) Filed: Nov. 3, 2022

(65) Prior Publication Data

US 2023/0151574 A1 May 18, 2023

(30) Foreign Application Priority Data

Nov. 17, 2021 (CN) ..... 202111363014.6

(51) Int. Cl.
*E02D 3/00* (2006.01)
*E02D 3/10* (2006.01)

(52) U.S. Cl.
CPC ..... *E02D 3/10* (2013.01)

(58) Field of Classification Search
CPC ..... E02D 3/10; E02D 3/00; B09C 1/005
See application file for complete search history.

(56) References Cited

U.S. PATENT DOCUMENTS 492,351 A * 2/1893 Emig ..... E03C 1/0401 137/445
3,198,249 A * 8/1965 Willman ..... E21B 43/243 166/250.15
3,677,008 A * 7/1972 Koutz ..... F02C 6/16 60/407

(Continued)

*Primary Examiner* — Edwin J Toledo-Duran
(74) *Attorney, Agent, or Firm* — Getech Law LLC; Jun Ye

(57) ABSTRACT

The present invention discloses a soft soil foundation single-hole depth air compression drainage device and working method thereof, comprising an air compression pipe and a water drainage pipe. A water drainage cavity body and an air diffusion cavity body are buried respectively in a soft soil foundation, and the air diffusion cavity body is located below the water drainage cavity body. Connecting to the air diffusion cavity body, the air compression pipe protrudes out of ground surface along a vertical direction of the soft soil foundation and communicates with an inflation pump; connecting to the water drainage cavity body, one end of the water drainage pipe protrudes to the bottom of the water drainage cavity body, and the other end protrudes out of the ground surface, thus achieving deep drainage and a drainage consolidation time of the deep soft soil foundation is shortened.

13 Claims, 2 Drawing Sheets

(56) References Cited

U.S. PATENT DOCUMENTS

| | | | | | |
|---|---|---|---|---|---|
| 3,742,716 | A * | 7/1973 | Backstrom | B65G 5/00 | 405/265 |
| 3,895,493 | A * | 7/1975 | Rigollot | F02C 6/16 | 60/659 |
| 3,939,356 | A * | 2/1976 | Loane | F02C 6/16 | 60/398 |
| 3,996,741 | A * | 12/1976 | Herberg | F03D 9/28 | 60/501 |
| 4,182,128 | A * | 1/1980 | Gardner | F03B 13/06 | 60/398 |
| 4,265,599 | A * | 5/1981 | Morton | F04F 1/06 | 417/54 |
| 7,281,371 | B1 * | 10/2007 | Heidenreich | F03B 13/06 | 60/398 |
| 9,494,127 | B2 * | 11/2016 | Hongawa | F03B 13/06 | |
| 9,726,150 | B2 * | 8/2017 | Littmann | F03B 13/06 | |
| 11,685,604 | B2 * | 6/2023 | Taggart, IV | B65G 5/00 | 405/220 |
| 11,870,253 | B2 * | 1/2024 | Ding | F01K 25/02 | |
| 2003/0211825 | A1 * | 11/2003 | Faltesek | F24F 11/32 | 454/338 |
| 2009/0173142 | A1 * | 7/2009 | Peters | B65G 5/005 | 73/152.05 |
| 2013/0101353 | A1 * | 4/2013 | Bousquet | B09C 1/02 | 405/128.3 |
| 2015/0034328 | A1 * | 2/2015 | Abouodah | B09C 1/002 | 166/370 |
| 2015/0176559 | A1 * | 6/2015 | Hongawa | F03B 15/14 | 60/398 |

* cited by examiner

SOFT SOIL FOUNDATION SINGLE-HOLE DEPTH AIR COMPRESSION DRAINAGE DEVICE AND WORKING METHOD THEREOF

CROSS REFERENCE TO THE RELATED APPLICATIONS

This application is based upon and claims priority to Chinese Patent Application No. 202111363014.6, filed on Nov. 17, 2021, the entire contents of which are incorporated herein by reference.

TECHNICAL FIELD

The present invention relates to the technical field of geotechnical engineering and in particular to a soft soil foundation single-hole depth air compression drainage device and a working method thereof.

BACKGROUND

The soft soil foundations have the features of high natural water content, large void ratio, strong compressibility, low permeability and poor bearing capacity and the like. When structures are built on the soft soil foundations, engineering load may extremely easily cause excessive settlement of the foundation and the consolidation settlement of the foundation may continue for a very long time due to low permeability of the soft soil. Especially under the engineering conditions of large soil layer thickness of the soft soil foundation, since the groundwater in the deep soft soil foundation has to run a long drainage path before flowing out of ground surface, the natural drainage consolidation may continue for several decades or even several hundred years. Excessive post-construction settlement usually affects normal use of engineering, and may even bring engineering disasters. The surcharge pre-loading method and the vacuum pre-loading method and the like currently adopted have good effect on drainage consolidation of shallow soft soils but poor effect on drainage consolidation of deep soft soils, resulting in long time of drainage consolidation treatment of deep soft soils and high engineering costs. The drainage consolidation of deep soft soil layer has become a difficult point in drainage consolidation treatments of soft soil foundation. Especially aiming at a bearing pile of a building, on an effective and narrow unit area, the drainage consolidation of the deep soft soil layer is extremely important. However, the existing deep soft soil consolidation treatment has the defects of long time and high engineering costs.

SUMMARY

In order to overcome the existing defects in the prior art, the present invention provides a soft soil foundation single-hole depth air compression drainage device applicable to bearing pile of a building for a structure and a working method thereof, which are used to drain deep groundwater in a soft soil foundation so as to accelerate drainage consolidation of deep soft soil and reduce post-construction foundation settlement and deformation.

The purpose of the present invention is achieved by using the following technical solution. The soft soil foundation single-hole depth air compression drainage device comprises an air compression pipe and a water drainage pipe. A water drainage cavity body and an air diffusion cavity body are buried respectively in a soft soil foundation. The air diffusion cavity body is located below the water drainage cavity body. A connection opening is opened on a top end surface of the air diffusion cavity body and is connected with the air compression pipe, and the air compression pipe protrudes out of ground surface along a vertical direction of the soft soil foundation and communicates with an inflation pump. A connection opening is opened on a top end surface of the water drainage cavity body and is connected with the water drainage pipe, one end of the water drainage pipe protrudes to the bottom of the water drainage cavity body, and the other end of the water drainage pipe protrudes out of the ground surface along the vertical direction of the soft soil foundation. With the disposal of the above drainage device in the soft soil foundation, deep drainage can be achieved for the soft soil foundation and a drainage consolidation time of the deep soft soil foundation is shortened, so as to reduce a saturation degree of the deep soil body and reduce the post-construction settlement and deformation of the soft soil foundation. Further, deep soft soil consolidation treatment is achieved for a bearing pile of a building on an effective and narrow unit area for the structure.

Preferably, the air diffusion cavity body comprises a rigid bracket and a geofabric. The rigid bracket is a cylindrical body which is externally wrapped with the geofabric and buried along a vertical direction of the soft soil foundation. With the disposal of the above structure, the rigidity of the air diffusion cavity body in the soft soil foundation can be guaranteed, and meanwhile, it has air permeability and can prevent soil body from entering the cavity.

Preferably, the water drainage cavity body is enclosed by a water-permeable pipe and buried along the vertical direction of the soft soil foundation. In this case, the water drainage cavity body has water permeability and can prevent soil body from entering the cavity.

Preferably, the air diffusion cavity body has an outer diameter greater than or equal to an outer diameter of the water drainage cavity body, and the air diffusion cavity body is located right below the water drainage cavity body so that the soft soil foundation is more convenient in the deep hole drilling process; and meanwhile, the air diffusion cavity body and the water drainage cavity body are more convenient to place, since the air diffusion cavity body is located right below the water drainage cavity body, the air pressure of the air diffusion cavity body can be always uniformly surrounded around the water drainage cavity body, in this way, the underground water permeating from the soil body to the water drainage cavity body is more rapid, underground water in the soil around the two cavities permeates more uniformly, and effective treatment of deep soft soil foundation can be further promoted on an effective and narrow unit area.

Preferably, a distance between the water drainage cavity body and a ground surface of the soft soil foundation is greater than 8 m, and a distance between the air diffusion cavity body and the water drainage cavity body is 5 m to 10 m. This helps air compression toward the air diffusion cavity body and water drainage out of the ground surface from the water drainage cavity body and the distance may be adjusted to adapt to time control requirements of drainage consolidation and soft soil consolidation with requirements of different depths and areas and better adapt to deep soft soil consolidation treatment for bearing piles which have different lengths on an effective and narrow unit area of structures.

A working method using the soft soil foundation single-hole depth air compression drainage device as mentioned above is provided, which includes the following steps.

Step S1, drill a deep hole with a depth of at least 13 m in the soft soil foundation, place an air diffusion cavity body with air compression pipe at the bottom of the deep hole; fill the soil into the deep hole until the height of the soil reaches at least 5 m or above, then place the water drainage cavity body with water drainage pipe on the filled soil, and fill the soil into the deep hole again until they are flush with the ground surface of the soft soil foundation.

Step S2, an inflation pump is used to compress air into the air compression pipe such that the air diffusion cavity body forms a high air pressure and maintains this pressure greater than a pore water pressure of surrounding soil body and less than a self-weight pressure of the soil body, and the air in the air diffusion cavity body is squeezed and diffused toward surrounding soil bodies to drive groundwater in the soil bodies to flow along a maximum pressure gradient direction.

Step S3, during an inflation process of the air diffusion cavity body, the pressure in the water drainage cavity body rises. When a pressure head in the water drainage cavity body reaches the ground surface, groundwater seeping into the water drainage cavity body flows out of the ground surface through the water drainage pipe.

The present invention has the following beneficial effects: by using the soft soil foundation single-hole depth air compression drainage device and in combination with use of an air compression drainage method, the followings can be achieved: 1. deep drainage of the soft soil foundation can be achieved, drainage consolidation time of the deep soft soil can be shortened, and deep soft soil consolidation treatment can be achieved for a bearing pile of a building on an effective and narrow unit area for the structure; 2. by adjusting the distance between the water drainage cavity body and the air diffusion cavity body, time control requirements of drainage consolidation can be satisfied; 3. during a drainage process, it is only required to compress air into the air diffusion cavity body and drive groundwater by air pressure to flow out of the soil body, resulting in low energy consumption.

Preferably, in steps S2 and S3, when the air compression pipe is pressurized, the air diffusion cavity body is in a high pressure state; by using the high pressure condition of the air diffusion cavity body, groundwater of its surrounding soil bodies is driven to flow to a neighboring water drainage cavity body having lower pressure and then discharged out of ground surface by the water drainage pipe; further, more efficient water drainage can be achieved using air pressure, such that the water seeping efficiency of the water drainage cavity body is greatly increased, causing the deep groundwater to flow out of the ground surface through the water drainage pipe.

BRIEF DESCRIPTIONS OF THE DRAWINGS

The numerals of the drawings are described below: 1. air compression pipe, 2. water drainage pipe, 3. water drainage cavity body, 4. air diffusion cavity body, 5. inflation pump, 6. soft soil foundation, 41. rigid bracket, 42. geofabric.

DETAILED DESCRIPTIONS OF EMBODIMENTS

Figure 1:
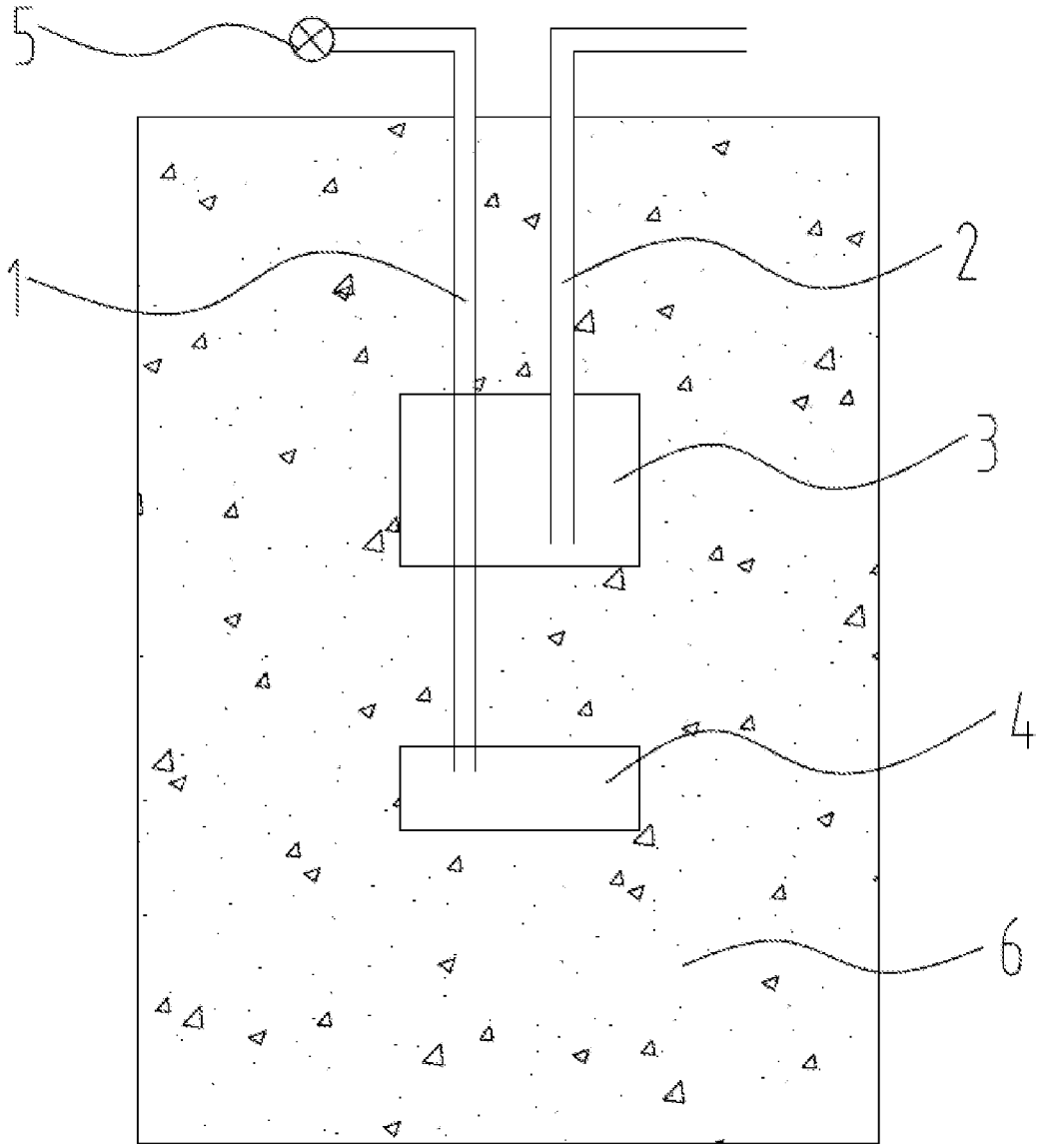
FIG. 1 is a structural schematic diagram illustrating a soft soil foundation single-hole depth air compression drainage device according to the present invention.

The present invention will be detailed in combination with accompanying drawings. As shown in FIG. 1, the present invention comprises an air compression pipe 1 and a water drainage pipe 2. A water drainage cavity body 3 and an air diffusion cavity body 4 are buried respectively in a soft soil foundation 6. The air diffusion cavity body 4 is located below the water drainage cavity body 3. A connection opening is opened on a top end surface of the air diffusion cavity body 4 and is connected with the air compression pipe 1, and the air compression pipe 1 protrudes out of ground surface along a vertical direction of the soft soil foundation 6 and communicates with an inflation pump 5. A connection opening is opened on a top end surface of the water drainage cavity body 3 and is connected with the water drainage pipe 2, and one end of the water drainage pipe 2 protrudes to the bottom of the water drainage cavity body 3 such that water seeping into the water drainage cavity body 3 from the soil body can be discharged out of the ground surface through the water drainage pipe 2 as possible and meanwhile unnecessary consumption of drainage drive pressure can be avoided. The other end of the water drainage pipe 2 protrudes out of the ground surface along the vertical direction of the soft soil foundation 6. The drainage drive pressure of the water drainage cavity body 3 comes from a seepage pressure conveyed by the air pressure. The vertical direction mentioned above refers to a direction perpendicular to the ground surface, such that the air compression of the air compression pipe 1 to the air diffusion cavity body 4 and the air compression and drainage efficiency of the water drainage cavity body 3 to the water drainage pipe 2 are more efficient. In this case, a path for air compression and water drainage is greatly shortened, helping more to shorten the drainage consolation time of the deep soft soil foundation.

Figure 2:
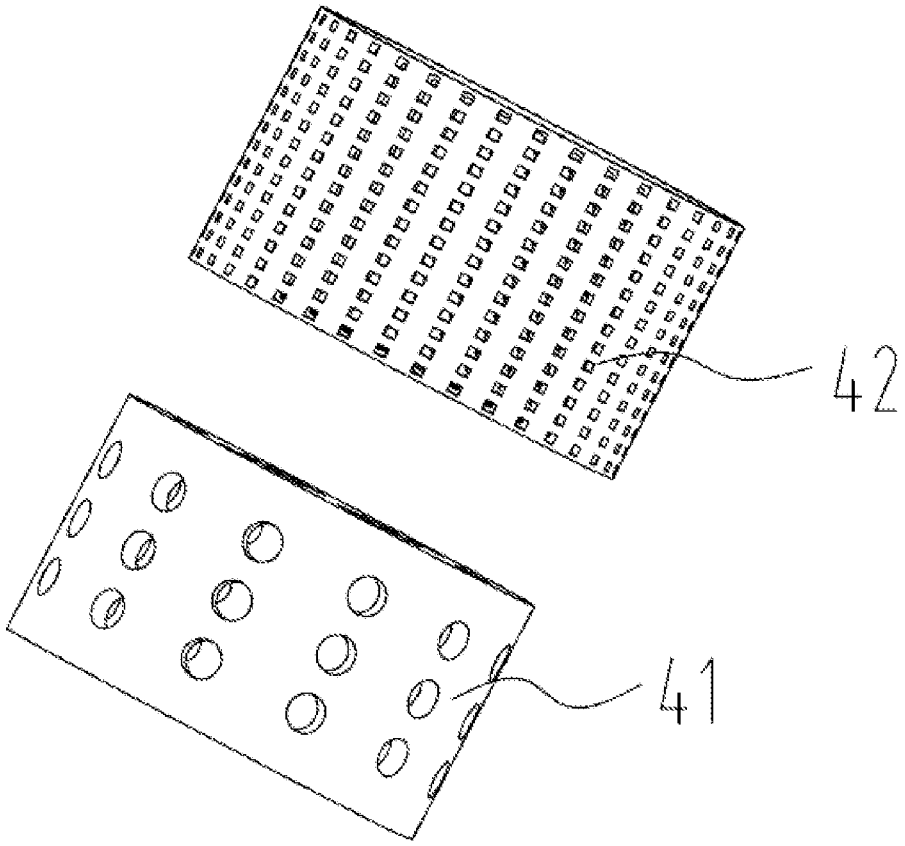
FIG. 2 is a structural schematic diagram illustrating an air diffusion cavity body according to the present invention.

As shown in FIG. 2, the air diffusion cavity body 4 comprises a rigid bracket 41 and a geofabric 42. The rigid bracket 41 is a cylindrical body which is externally wrapped with the geofabric 42 and buried along a vertical direction of the soft soil foundation 6. The water drainage cavity body 3 is enclosed by a water-permeable pipe and buried along the vertical direction of the soft soil foundation 6. The vertical burying mentioned above means that axes of the two cavities are perpendicular to the ground surface. In this way, the spatial arrangement will be more compact and the drainage efficiency will be higher. At the same time, deep soft soil consolidation treatment can be achieved for a bearing pile on an effective and narrow unit area for the structure.

The air diffusion cavity body 4 has an outer diameter greater than or equal to an outer diameter of the water drainage cavity body 3. Since the hole drilled is deep enough for a convenient placement of the air diffusion cavity body 4 and the water drainage cavity body 3, and the air diffusion cavity body 4 is located right below the water drainage cavity body 3, that is, the axe of the air diffusion cavity body 4 and the axe of the water drainage cavity body 3 are located on the same straight line, the air pressure of the air diffusion cavity body 4 can be always uniformly surrounded around the water drainage cavity body 3, in this way, the transmission of the air pressure driving seepage pressure is more efficient, which further promotes the underground water in the soil permeate into the water drainage cavity body 3 and meanwhile the drainage efficiency of the water drainage pipe 2 is further improved.

As a principle, air and liquid always flow along a maximum pressure gradient direction and a pressure gradient is directly proportional to a pressure difference between two points and inversely proportional to a distance of two points. The distance between the water drainage cavity body 3 and the ground surface of the soft soil foundation 6 is more than 8 m, and the distance between the air diffusion cavity body 4 and the water drainage cavity body 3 is 5 m to 10 m. The larger the distance between the air diffusion cavity body 4 and the water drainage cavity body 3 is, the longer the water drainage takes. But, based on actual requirements, if the deep soft soil drainage consolidation is large in depth, it is required to increase the distance between the air diffusion cavity body 4 and the water drainage cavity body 3 while increasing the distance between the water drainage cavity body 3 and the ground surface of the soft soil foundation 6. In this way, the extension of the drainage consolidation time of the deep soft soil can be overcome, and better adapt to deep soft soil consolidation treatment for bearing piles which have different lengths on an effective and narrow unit area of structures.

A working method using the soft soil foundation single-hole depth air compression drainage device, which includes the following steps.

Step S1, drill a deep hole with a depth of at least 13 m in the soft soil foundation 6, place an air diffusion cavity body 4 with air compression pipe 1 at the bottom of the deep hole; fill the soil into the deep hole until the height of the soil reaches at least 5 m or above, then place the water drainage cavity body 3 with water drainage pipe 2 on the filled soil, and fill the soil into the deep hole again until they are flush with the ground surface of the soft soil foundation 6. The depth of the deep hole is commonly 15 m, the filled soil body does not need to be compacted, and the water drainage pipe 2 on the water drainage cavity body 3 and the air compression pipe 1 on the air diffusion cavity body 4 are distributed in a staggered mode, so that the water drainage cavity body 3 cannot be interfered when the air compression pipe 1 extends out of the ground surface, Step S2, an inflation pump 5 is used to compress air into the air compression pipe 1 such that the air diffusion cavity body 4 forms a high air pressure and maintains the pressure in the air diffusion cavity body 4 greater than a pore water pressure of surrounding soil body and less than a self-weight pressure of the soil body, and the air in the air diffusion cavity body 4 is squeezed and diffused toward surrounding soil bodies to drive groundwater in the soil bodies to flow along a maximum pressure gradient direction.

Step S3, during an inflation process of the air diffusion cavity body 4, the pressure in the water drainage cavity body 3 rises. When a pressure head in the water drainage cavity body 3 reaches the ground surface, groundwater seeping into the water drainage cavity body 3 flows out of the ground surface through the water drainage pipe 2.

In steps S2 and S3, when the air compression pipe 1 is pressurized, the air diffusion cavity body 4 is in a high pressure state; by using the high pressure condition of the air diffusion cavity body 4, groundwater of its surrounding soil bodies is driven to flow to a neighboring water drainage cavity body 3 having lower pressure and then discharged out of ground surface by the water drainage pipe 2. The driving pressure of the water drainage cavity body 3 comes from the transmission of the seepage pressure driven by the air pressure in the air diffusion cavity body 4, when the water drainage cavity body 3 and the air diffusion cavity body 4 is relatively close, the driving efficiency of the compressed air in the air diffusion cavity body 4 entering the water drainage cavity body 3 through the soil body is more efficient, the drainage efficiency can be further improved, and the drainage consolidation time of the deep soft soil is shortened.

The present invention is not limited to the above embodiments, and any changes to its shape or material shall be considered as a variation of the present invention and fall in the scope of protection of the present invention as long as the structural design of the present invention is adopted.

What is claimed is:

1. A soft soil foundation single-hole depth air compression drainage device, comprising:
- an air compression pipe (1) and a water drainage pipe (2), wherein
  - a water drainage cavity body (3) and an air diffusion cavity body (4) are buried respectively in a soft soil foundation (6),
  - the air diffusion cavity body (4) is located below the water drainage cavity body (3),
  - the air diffusion cavity body (4) comprises a rigid bracket (41) and a geofabric (42),
  - the rigid bracket (41) is a cylindrical body which is externally wrapped with the geofabric (42) and buried along a vertical direction of the soft soil foundation (6), and
  - the water drainage cavity body (3) is enclosed by a water-permeable pipe and buried along the vertical direction of the soft soil foundation (6);
- a first connection opening is opened on a top end surface of the air diffusion cavity body (4) and is connected with the air compression pipe (1), wherein
  - the air compression pipe (1) protrudes out of a ground surface along the vertical direction of the soft soil foundation (6) and communicates with an inflation pump (5);
- a second connection opening is opened on a top end surface of the water drainage cavity body (3) and is connected with the water drainage pipe (2), wherein
  - one end of the water drainage pipe (2) protrudes to a bottom of the water drainage cavity body (3), and
  - other end of the water drainage pipe (2) protrudes out of the ground surface along the vertical direction of the soft soil foundation (6).

2. The soft soil foundation single-hole depth air compression drainage device of claim 1, wherein
- the air diffusion cavity body (4) has an outer diameter greater than or equal to an outer diameter of the water drainage cavity body (3), and
- the air diffusion cavity body (4) is located right below the water drainage cavity body (3).

3. The soft soil foundation single-hole depth air compression drainage device of claim 1, wherein
- a distance between the water drainage cavity body (3) and the ground surface of the soft soil foundation (6) is more than 8 m, and
- a distance between the air diffusion cavity body (4) and the water drainage cavity body (3) is between 5 m to 10 m.

4. A working method using the soft soil foundation single-hole depth air compression drainage device of claim 1, which includes the following steps:
- step S1, drill a deep hole with a depth of at least 13 m in the soft soil foundation (6),
- place an air diffusion cavity body (4) with air compression pipe (1) at a bottom of the deep hole;
- fill the soil into the deep hole until height of the soil reaches at least 5 m or above, then place the water drainage cavity body (3) with water drainage pipe (2) on the filled soil, and fill the soil into the deep hole again until they are flush with the ground surface of the soft soil foundation (6);
- step S2, an inflation pump (5) is used to compress air into the air compression pipe (1) such that the air diffusion cavity body (4) forms a high air pressure and maintains the high air pressure in the air diffusion cavity body (4) greater than a pore water pressure of surrounding soil body and less than a self-weight pressure of the soil body, and the air in the air diffusion cavity body (4) is squeezed and diffused toward surrounding soil bodies to drive groundwater in the soil bodies to flow along a maximum pressure gradient direction;

step S3, during an inflation process of the air diffusion cavity body (4), the high-air pressure in the water drainage cavity body (3) rises; when a pressure head in the water drainage cavity body (3) reaches the ground surface, groundwater seeping into the water drainage cavity body (3) flows out of the ground surface through the water drainage pipe (2).

5. A working method using the soft soil foundation single-hole depth air compression drainage device of claim 1, which includes the following steps:

step S1, drill a deep hole with a depth of at least 13 m in the soft soil foundation (6), place an air diffusion cavity body (4) with air compression pipe (1) at a bottom of the deep hole; fill the soil into the deep hole until a height of the soil reaches at least 5 m or above, then place the water drainage cavity body (3) with water drainage pipe (2) on the filled soil, and fill the soil into the deep hole again until they are flush with the ground surface of the soft soil foundation (6);

step S2, an inflation pump (5) is used to compress air into the air compression pipe (1) such that the air diffusion cavity body (4) forms a high air pressure and maintains the high air pressure in the air diffusion cavity body (4) greater than a pore water pressure of surrounding soil body and less than a self-weight pressure of the soil body, and the air in the air diffusion cavity body (4) is squeezed and diffused toward surrounding soil bodies to drive groundwater in the soil bodies to flow along a maximum pressure gradient direction;

step S3, during an inflation process of the air diffusion cavity body (4), the high air pressure in the water drainage cavity body (3) rises; when a pressure head in the water drainage cavity body (3) reaches the ground surface, groundwater seeping into the water drainage cavity body (3) flows out of the ground surface through the water drainage pipe (2).

6. A working method using the soft soil foundation single-hole depth air compression drainage device of claim 1, which includes the following steps:

step S1, drill a deep hole with a depth of at least 13 m in the soft soil foundation (6), place an air diffusion cavity body (4) with air compression pipe (1) at a bottom of the deep hole; fill the soil into the deep hole until a height of the soil reaches at least 5 m or above, then place the water drainage cavity body (3) with water drainage pipe (2) on the filled soil, and fill the soil into the deep hole again until they are flush with the ground surface of the soft soil foundation (6);

step S2, an inflation pump (5) is used to compress air into the air compression pipe (1) such that the air diffusion cavity body (4) forms a high air pressure and maintains the high air pressure in the air diffusion cavity body (4) greater than a pore water pressure of surrounding soil body and less than a self-weight pressure of the soil body, and the air in the air diffusion cavity body (4) is squeezed and diffused toward surrounding soil bodies to drive groundwater in the soil bodies to flow along a maximum pressure gradient direction;

step S3, during an inflation process of the air diffusion cavity body (4), the high air pressure in the water drainage cavity body (3) rises; when a pressure head in the water drainage cavity body (3) reaches the ground surface, groundwater seeping into the water drainage cavity body (3) flows out of the ground surface through the water drainage pipe (2).

7. A working method using the soft soil foundation single-hole depth air compression drainage device of claim 2, which includes the following steps:

step S1, drill a deep hole with a depth of at least 13 m in the soft soil foundation (6), place an air diffusion cavity body (4) with air compression pipe (1) at a bottom of the deep hole; fill soil into the deep hole until a height of the soil reaches at least 5 m or above, then place the water drainage cavity body (3) with the water drainage pipe (2) on the filled soil, and fill the soil into the deep hole again until they are flush with the ground surface of the soft soil foundation (6);

step S2, an inflation pump (5) is used to compress air into the air compression pipe (1) such that the air diffusion cavity body (4) forms a high air pressure and maintains the high air pressure in the air diffusion cavity body (4) greater than a pore water pressure of surrounding soil body and less than a self-weight pressure of the soil body, and the air in the air diffusion cavity body (4) is squeezed and diffused toward surrounding soil bodies to drive groundwater in the surrounding soil bodies to flow along a maximum pressure gradient direction; and step S3, during an inflation process of the air diffusion cavity body (4), the high-air pressure in the water drainage cavity body (3) rises; when a pressure head in the water drainage cavity body (3) reaches the ground surface, groundwater seeping into the water drainage cavity body (3) flows out of the ground surface through the water drainage pipe (2).

8. A working method using the soft soil foundation single-hole depth air compression drainage device of claim 3, which includes the following steps:

step S1, drill a deep hole with a depth of at least 13 m in the soft soil foundation (6), place the air diffusion cavity body (4) with the air compression pipe (1) at a bottom of the deep hole; fill soil into the deep hole until a height of the soil reaches at least 5 m or above, then place the water drainage cavity body (3) with the water drainage pipe (2) on the filled soil, and fill the soil into the deep hole again until they are flush with the ground surface of the soft soil foundation (6);

step S2, an inflation pump (5) is used to compress air into the air compression pipe (1) such that the air diffusion cavity body (4) forms a high air pressure and maintains the high air pressure in the air diffusion cavity body (4) greater than a pore water pressure of surrounding soil body and less than a self-weight pressure of the soil body, and the air in the air diffusion cavity body (4) is squeezed and diffused toward surrounding soil bodies to drive groundwater in the surrounding soil bodies to flow along a maximum pressure gradient direction; and step S3, during an inflation process of the air diffusion cavity body (4), the high air pressure in the water drainage cavity body (3) rises; when a pressure head in the water drainage cavity body (3) reaches the ground surface, groundwater seeping into the water drainage cavity body (3) flows out of the ground surface through the water drainage pipe (2).

9. The working method using the soft soil foundation single-hole depth air compression drainage device of claim 4, wherein in steps S2 and S3, when the air compression pipe (1) is pressurized, the air diffusion cavity body (4) is in a high pressure state; by using a high pressure condition of the air diffusion cavity body (4), groundwater of its surrounding soil bodies is driven to flow to a neighboring water drainage cavity body (3) having lower pressure and then discharged out of the ground surface by the water drainage pipe (2).

10. The working method using the soft soil foundation single-hole depth air compression drainage device of claim 5, wherein in steps S2 and S3, when the air compression pipe (1) is pressurized, the air diffusion cavity body (4) is in a high pressure state; by using a high pressure condition of the air diffusion cavity body (4), groundwater of its surrounding soil bodies is driven to flow to a neighboring water drainage cavity body (3) having lower pressure and then discharged out of the ground surface by the water drainage pipe (2).

11. The working method using the soft soil foundation single-hole depth air compression drainage device of claim 6, wherein in steps S2 and S3, when the air compression pipe (1) is pressurized, the air diffusion cavity body (4) is in a high pressure state; by using a high pressure condition of the air diffusion cavity body (4), groundwater of its surrounding soil bodies is driven to flow to a neighboring water drainage cavity body (3) having lower pressure and then discharged out of the ground surface by the water drainage pipe (2).

12. The working method using the soft soil foundation single-hole depth air compression drainage device of claim 7, wherein in steps S2 and S3, when the air compression pipe (1) is pressurized, the air diffusion cavity body (4) is in a high pressure state; by using a high pressure condition of the air diffusion cavity body (4), groundwater of its surrounding soil bodies is driven to flow to a neighboring water drainage cavity body (3) having lower pressure and then discharged out of the ground surface by the water drainage pipe (2).

13. The working method using the soft soil foundation single-hole depth air compression drainage device of claim 8, wherein in steps S2 and S3, when the air compression pipe (1) is pressurized, the air diffusion cavity body (4) is in a high pressure state; by using a high pressure condition of the air diffusion cavity body (4), groundwater of its surrounding soil bodies is driven to flow to a neighboring water drainage cavity body (3) having lower pressure and then discharged out of the ground surface by the water drainage pipe (2).

* * * * *